US012044031B2

(12) United States Patent
Huang et al.

(10) Patent No.: US 12,044,031 B2
(45) Date of Patent: Jul. 23, 2024

(54) ABOVE-GROUND POOL

(71) Applicant: BESTWAY INFLATABLES & MATERIAL CORP., Shanghai (CN)

(72) Inventors: Shuiyong Huang, Shanghai (CN); Xiaobo Chen, Jinhua (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

(21) Appl. No.: 17/688,083

(22) Filed: Mar. 7, 2022

(65) Prior Publication Data

US 2022/0298817 A1 Sep. 22, 2022

(30) Foreign Application Priority Data

Mar. 16, 2021 (CN) ..... 202120540223.2

(51) Int. Cl.
*E04H 4/00* (2006.01)
*E04H 4/14* (2006.01)

(52) U.S. Cl.
CPC ..... *E04H 4/005* (2013.01); *E04H 2004/146* (2013.01)

(58) Field of Classification Search
CPC ..... E04H 4/005; E04H 2004/14
USPC ..... 4/506
See application file for complete search history.

(56) References Cited

U.S. PATENT DOCUMENTS 3,233,251 A * 2/1966 Barrera ..... E04H 4/0018 220/4.16
3,268,917 A * 8/1966 Diemond ..... E04H 4/00 220/668
3,274,621 A * 9/1966 Diemond ..... E04H 4/0043 D25/2
3,280,408 A * 10/1966 Gershman ..... E04H 4/0043 220/642
3,428,969 A * 2/1969 Gershman ..... E04H 4/0043 D25/2
3,745,593 A * 7/1973 Wall ..... E04H 4/0018 52/169.7
4,062,158 A * 12/1977 Kaufmann ..... E04H 4/0018 52/71

(Continued)

FOREIGN PATENT DOCUMENTS

CN 203879057 10/2014
CN 205348866 6/2016

*Primary Examiner* — David P Angwin
*Assistant Examiner* — William R Klotz
(74) *Attorney, Agent, or Firm* — DICKINSON WRIGHT PLLC

(57) ABSTRACT

An above-ground pool is provided including a base; a surrounding wall joined to the base; and a pool liner, detachably connected to an inner side of the surrounding wall, the pool liner defining a water storage space therein. A support assembly of the pool comprises: horizontal and vertical support members, first connecting members, each connecting an upper end of one of the vertical support members to two of the horizontal support members, and second connecting members, each connecting a lower end of one of the vertical support members to the base. Each of the first connecting members has a first insertion slot having a shape corresponding to one of the vertical support members. Each of the second connecting members has a second insertion slot having a shape corresponding to one of the vertical support members.

19 Claims, 7 Drawing Sheets

(56) References Cited

U.S. PATENT DOCUMENTS

| | | | | | |
|---|---|---|---|---|---|
| 5,054,135 | A * | 10/1991 | Dallaire | E04H 4/005 | 4/488 |
| 5,231,807 | A * | 8/1993 | Aymes | E04H 4/0018 | 52/71 |
| 5,875,500 | A * | 3/1999 | Shaanan | E04H 4/005 | 403/348 |
| 10,036,173 | B2 * | 7/2018 | Liu | E04H 4/0056 | |
| 2015/0315804 | A1 * | 11/2015 | Liu | E04H 4/14 | 4/506 |

* cited by examiner

ABOVE-GROUND POOL

CROSS-REFERENCE TO RELATED APPLICATION

This application claims priority from Chinese Application CN202120540223.2, filed Mar. 16, 2021 in China, the disclosure of which is incorporated herein by reference in its entirety.

BACKGROUND

1. Field

Apparatuses and methods consistent with exemplary embodiments relate to an above-ground pool, and more specifically to an assembled above-ground pool.

2. Description of the Related Art

An assembled above-ground pool, as a common form of above-ground pool, has advantages such as easy installation and storage and a long service life. An assembled above-ground pool may further be provided with a rigid surrounding wall. Such a rigid surrounding wall can aid in the prevention of punctures to the water storage space formed by PVC or PU rubberized fabric.

Chinese Patent Publication No. CN 203879057 U describes an above-ground swimming pool with a rigid surrounding wall. The annular surrounding wall is bendable in the horizontal direction and is rigid in the vertical direction. A waterproof liner is placed on an inner side of the annular surrounding wall, and an upper edge of the waterproof liner is folded and supported by an upper edge of the annular surrounding wall. The above-ground swimming pool further comprises a horizontal support member and a vertical post that are located on an outer side of the annular surrounding wall and are connected to each other. As shown in FIG. 1 and FIG. 2, a horizontal support member 100 and a vertical post 200 are connected by an upper fixing member 300, and the vertical post 200 is supported, in the vertical direction, by a lower fixing member 400. All fixing members are bolt fastenings. The upper fixing member 300 comprises a vertical post top cover 301, a first protective cover 302, and a second protective cover 303. The vertical post top cover 301 is used for connecting adjacent horizontal support members 100 and connecting the vertical post 200 and the horizontal support members 100. These connections use a relatively large quantity of bolt fasteners. The first protective cover 302 and the second protective cover 303 fixedly clamp and cover a joint between ends of two adjacent horizontal support members 100. The second protective cover 303 is separately connected to the vertical post 200 and the vertical post top cover 301 by bolt fasteners. Accordingly, the quantity of required mounting parts is increased, and the vertical post top cover 301 and the second protective cover 303 need to be separately installed, requiring causing complex installation and disassembly of the pool.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, an above-ground pool comprises: a base; a surrounding wall comprising: a lower edge joined to the base, and an upper edge; a pool liner, detachably connected to an inner side of the surrounding wall, the pool liner defining a water storage space therewithin; and a support assembly, comprising: a plurality of horizontal support members, a plurality of vertical support members, a plurality of first connecting members, each connecting an upper end of one of the plurality of vertical support members to two of the plurality of horizontal support members, and a plurality of second connecting members, each connecting a lower end of one of the plurality of vertical support members to the base. Each of the plurality of first connecting members comprises a first insertion slot having a shape corresponding to a contour of the one of the plurality of vertical support members. Each of the plurality of second connecting members comprises a second insertion slot having a shape corresponding to the contour of the one of the plurality of vertical support members.

Each of the plurality of the first connecting members may comprise: a connecting member body comprising the first insertion slot and a positioning post disposed opposite the first insertion slot, the positioning post configured to connect to end portions of the two of the plurality of horizontal support members, and a protective cover.

Each of the plurality of horizontal support members may comprise a through hole, formed through an end thereof and configured to hold the positioning post.

The protective cover may limit a separation of the two of the plurality of horizontal support members from the positioning post, and the protective cover may be configured to be fixed to the connecting member body by at least one of clamping and threaded fastening.

The protective cover may comprise a convex tooth disposed on an inner side of the protective cover, and each of the plurality of horizontal support members may comprise a groove, disposed in a surface thereof and having a shape corresponding to a shape of the convex tooth.

The connecting member body may further comprise a first receiving groove configured to accommodate therein the upper edge of the surrounding wall, and each of the plurality of second connecting members may comprise a second receiving groove configured to accommodate therein the lower edge of the surrounding wall.

The connecting member body may further comprise a first connecting hole; each of the plurality of second connecting members may further comprise a second connecting hole, and each of the lower end and the upper end of each of the plurality of vertical support members may comprise a mounting hole configured to be connected to one of the first connecting hole and the second connecting hole by a threaded fastener.

The connecting member body may consist of a single integral member.

Each of the plurality of first connecting members and the plurality of second connecting members may be plastic.

The surrounding wall may be rigid in a first direction and is rollable in a second direction, perpendicular to the first direction.

According to an aspect of another example embodiment, a support assembly of an above-ground pool comprises: a plurality of horizontal support members; a plurality of vertical support members; a plurality of first connecting members, each connecting an upper end of one of the plurality of vertical support members to two of the plurality of horizontal support members; and a plurality of second connecting members, each connecting a lower end of one of the plurality of vertical support members to a base of the above-ground pool. Each of the plurality of first connection members comprises a first insertion slot having a shape corresponding to a contour of the one of the plurality of vertical support members. Each of the plurality of second connecting members comprises a second insertion slot having a shape corresponding to the contour of the one of the plurality of vertical support members.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
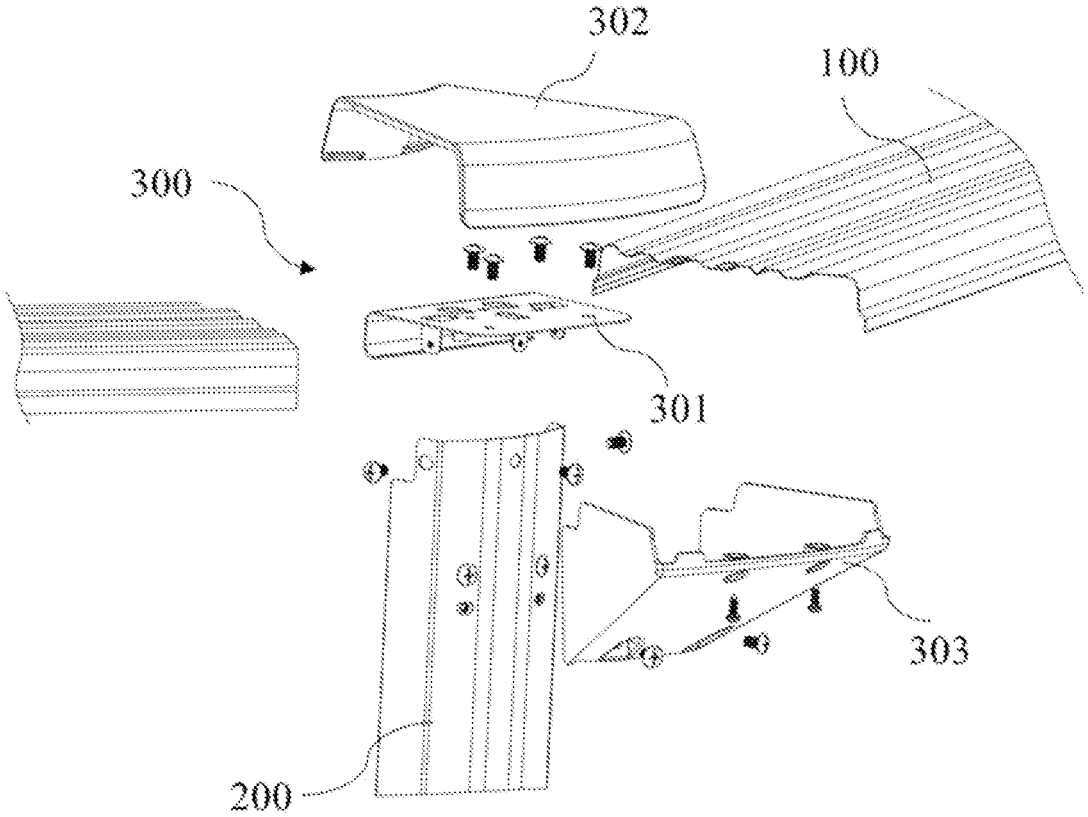
FIG. 1 is a schematic exploded view of a horizontal support member and a vertical post connected by an upper fixing member, according to the related art.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these exemplary embodiments pertain may not be described here in detail.

Figure 3:
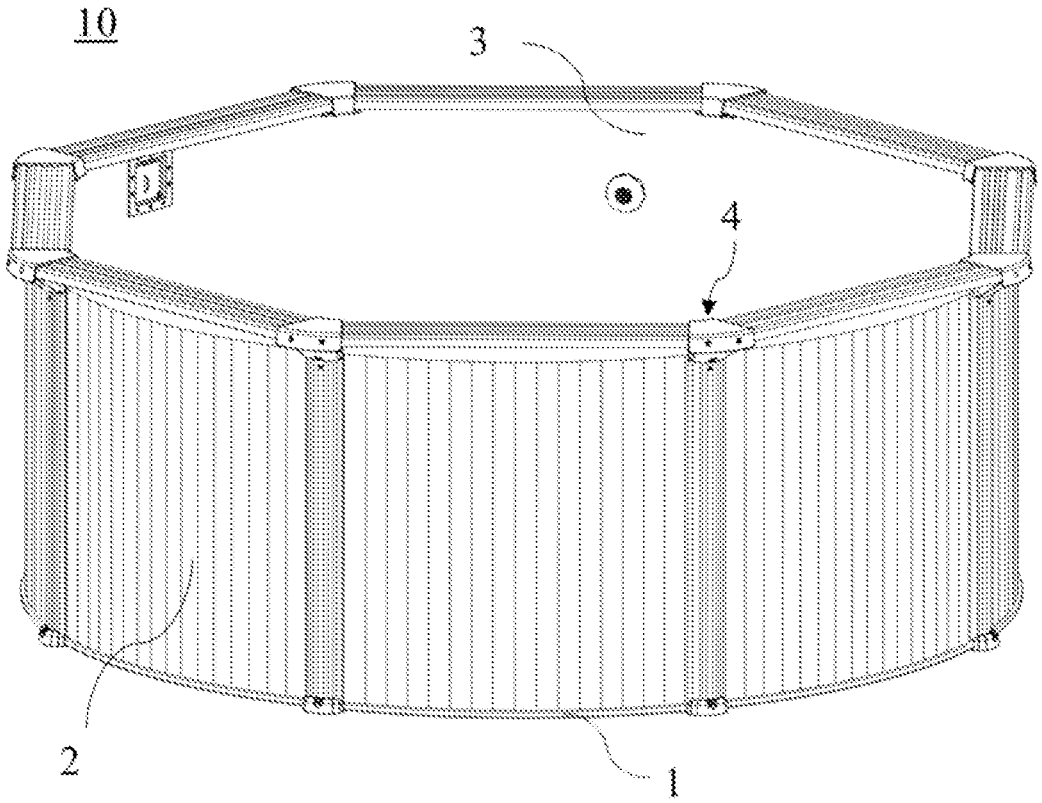
FIG. 3 is a three-dimensional schematic diagram of an above-ground pool according to an example embodiment.

FIG. 3 illustrates an above-ground pool 10, according to an example embodiment. The pool 10 includes an annular base 1, an annular surrounding wall 2, a pool liner 3, and a support assembly 4. Specifically, the support assembly 4 is located on an outer side of the annular surrounding wall 2. The pool liner 3 can be fixed on an inner side of the annular surrounding wall 2 and forms a water storage space. The pool liner 3 usually covers the inner side of the overall annular surrounding wall 2 and a bottom surface of the annular surrounding wall 2. An upper edge of the pool liner 3 may be folded and supported by an upper edge of the annular surrounding wall 2. At the position where the upper edge of the pool liner 3 is folded and propped, a clamping member, including a downward-facing groove, fixedly clamps the upper edge of the pool liner 3 and the upper edge of the annular surrounding wall 2. The pool liner 3 may be a waterproof, flexible material. After the upper edge of the pool liner is folded, supported by the upper edge of the annular surrounding wall 2, and fixedly clamped, the shape and size of the bottom of the pool liner 3 may substantially match the shape and size enclosed by the annular surrounding wall 2. A structure of the clamping member may be analogous to the slot-type clamping strip described in Chinese Patent Publication No. CN 203879057 U and/or to the clamping strip in Chinese Patent Publication No. CN 205348866 U. The entire disclosures of these foregoing patent publications are is incorporated herein by reference in their entireties. The inner side of the annular surrounding wall 2 may be provided with a plurality of hooks or with a substantially continuous hook-and-loop fastener. The upper edge of the pool liner 3 may be detachably fixed to the inner side of the annular surrounding wall 2 in a hanging or bonding manner.

The annular surrounding wall 2 defines the shape of the water storage space. The annular surrounding wall 2 is rigid in a support direction of the annular surrounding wall and is rollable in a non-support direction. The orientation of the elements, as illustrated in FIG. 3 is used as an example. As shown in FIG. 3, the vertical direction corresponds to the support direction, and the horizontal direction corresponds to a non-support direction. The annular surrounding wall 2 is rigid in the support direction to maintain keep the shape of the water storage space, but is rollable in the non-support direction to facilitate storage. During assembly, a lower edge of the annular surrounding wall 2 is joined to the annular base 1. The annular base 1 may be provided with an upward-facing groove (not shown). The lower edge of the annular surrounding wall 2 is inserted into the upward groove, to enable the shape of the annular surrounding wall to adapt to the shape of the annular base. As the water storage space is filled, pressure is generated on the inner side of the annular surrounding wall 2, to cause a deformation of the annular surrounding wall 2. To mitigate or eliminate this deformation, the support assembly 4 may be disposed on the outer side of the annular surrounding wall 2.

Figure 4:
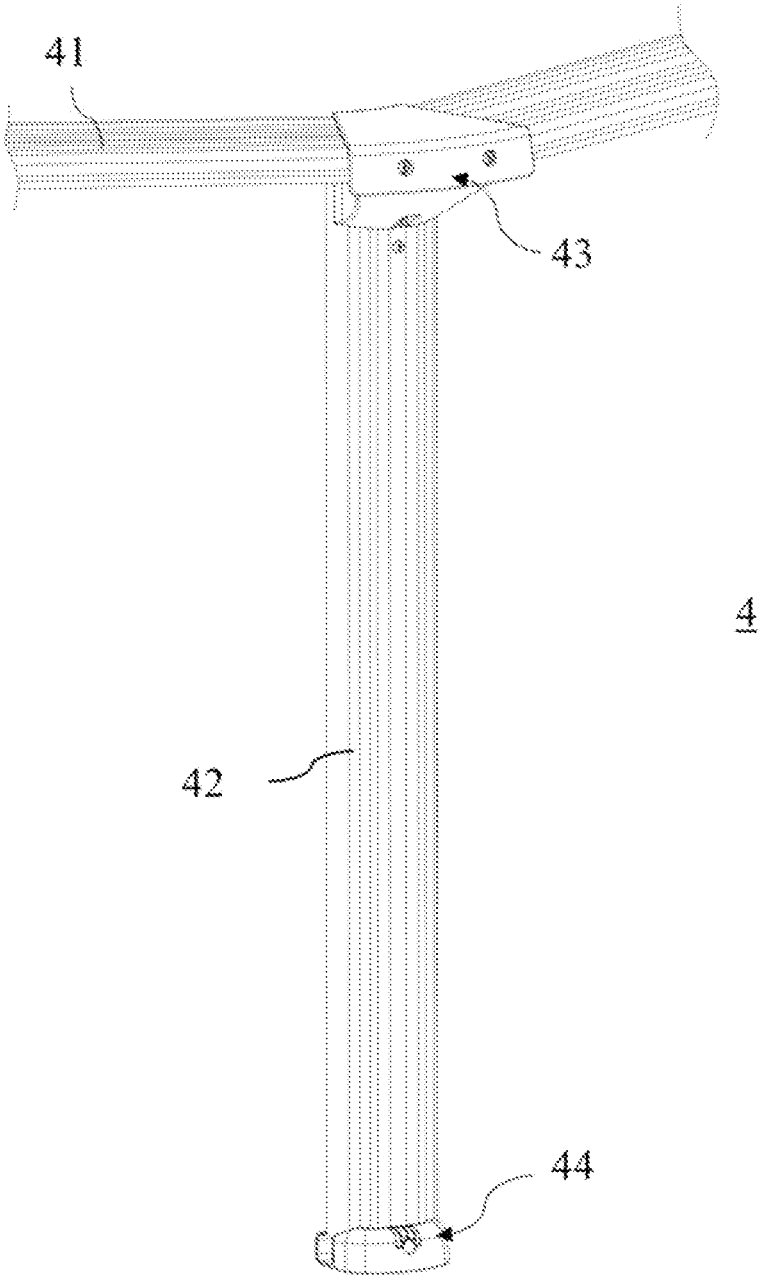
FIG. 4 is a partial three-dimensional schematic diagram of a support assembly of the above-ground pool of FIG. 3.
Figure 5A:
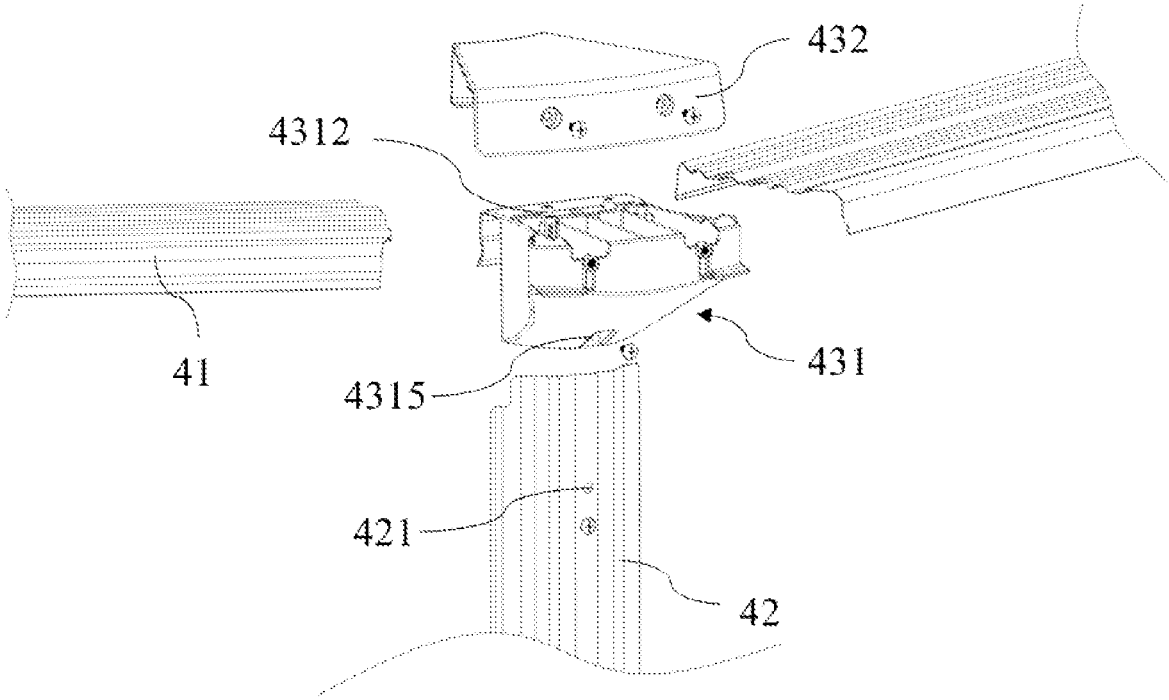
FIG. 5*a* is a schematic exploded view of an assembly of the first connecting member of FIG. 4.
Figure 5B:
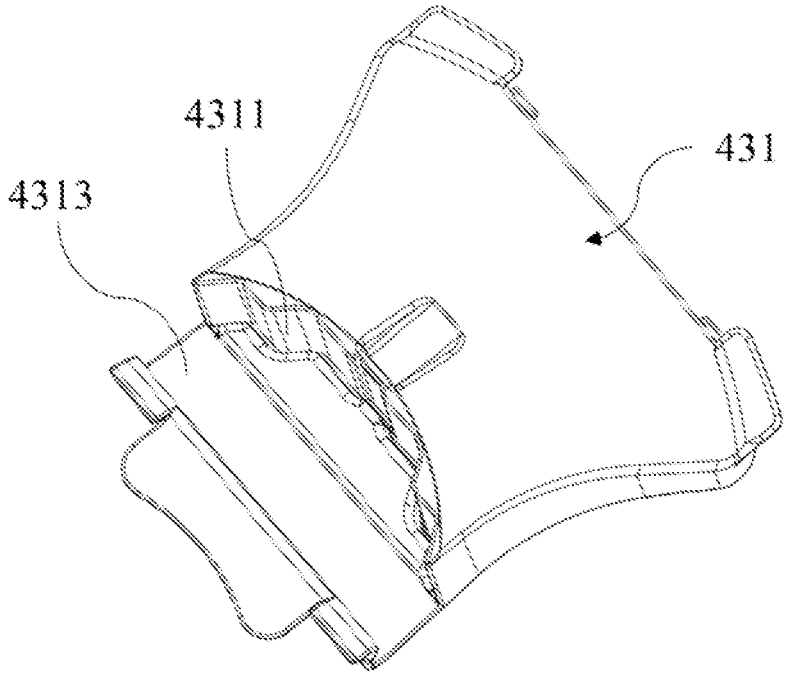
FIG. 5*b* is a three-dimensional schematic bottom view of a connecting member body of the first connecting member.

Specifically, as shown in FIG. 4, the support assembly 4 comprises a horizontal support member 41, a vertical support member 42, a first connecting member 43, and a second connecting member 44. The horizontal support member 41 covers the upper edge of the annular surrounding wall 2, and is connected to the vertical support member 42 by the first connecting member 43. The vertical support member 42 is connected to the annular base 1 by the second connecting member 44. More specifically, with reference to FIG. 5*a* to FIG. 6, the first connecting member 43 comprises a connecting member body 431 and a protective cover 432. A first insertion slot 4311 and a positioning post 4312 are respectively provided on two opposite sides of the connecting member body 431. The vertical support member 42 fits within the first insertion slot 4311, and is thereby connected to the connecting member body 431 from below the connecting member body 431. The horizontal support member 41 is attached to the positioning post 4312, and is thereby connected to the connecting member body 431 from above the connecting member body 431. As discussed above, the horizontal support member 41 covers the upper edge of the annular surrounding wall 2. Similarly, the connecting member body 431 covers the upper edge of the annular surrounding wall 2. According to an example aspect, a clamping member may be is disposed at the upper edge of the annular surrounding wall 2, and may comprise a downward groove that clamps the pool liner 3 at the annular surrounding wall 2. As shown in FIG. 5*b*, the connecting member body 431 comprises a first receiving groove 4313. The first receiving groove 4313 and the first insertion slot 4311 are located on the same side of the connecting member body 431. The first receiving groove 4313 is used for accommodating the upper edge of the annular surrounding wall 2, and may also accommodate a clamping member that is disposed at the upper edge of the annular surrounding wall 2 and is provided with a downward groove.

As can be seen, a top end of the vertical support member 42 is attached to the annular surrounding wall 2 by the connecting member body 431. The top end of the vertical support member 42 is inserted in the first insertion slot 4311 of the connecting member body 431, and the connecting member body 431 is thereby attached to the upper edge of the annular surrounding wall 2.

Figure 6:
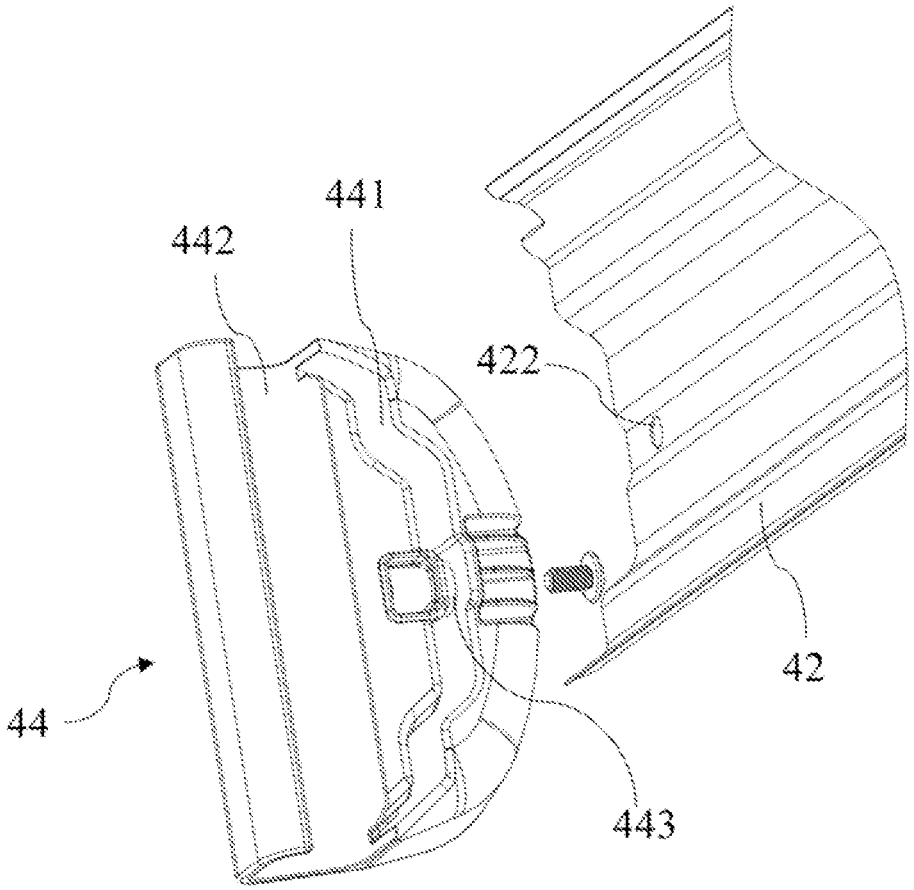
FIG. 6 is a schematic exploded view of an assembly of a second connecting member of FIG. 4.

Further, a bottom end of the vertical support member 42 is attached to the annular surrounding wall 2 by the second connecting member 44. As shown in FIG. 6, the second connecting member 44 has a second insertion slot 441 and a second receiving groove 442 located on the same side as the second insertion slot 441. The vertical support member is connected to the second insertion slot 441 from above the second connecting member 44. The second receiving groove 442 accommodates the lower edge of the annular surrounding wall 2. With reference to FIG. 3, the second receiving groove 442 accommodates the annular base 1 and thereby holds the lower edge of the annular surrounding wall 2.

After the installation of the vertical support member 42 is completed, the first insertion slot 4311 of the first connecting member 43 and the second insertion slot 441 of the second connecting member 44 are arranged opposite each other and are used for respectively inserting the top end and lower end of the vertical support member 42. The shapes of the first insertion slot 4311 and the second insertion slot 441 may be adapted to a contour of the vertical support member 42. The vertical support member 42 may have a three-dimensional contour. For example, a cross section of the vertical support member 42 may approximate an arc with a plurality of bends, to enhance the structural strength of the vertical support member 42 in a support direction (vertical direction) of the vertical support member. Correspondingly, the first insertion slot 4311 and the second insertion slot 441 may be disposed as nonlinear through slots with a plurality of bends.

As discussed above, a prepositioning structure of the vertical support member 42 is described. The prepositioning structure of the horizontal support member 41 is described below in detail.

As shown in FIG. 7*a* to FIG. 8*b*, the connecting member body 431 of the first connecting member 43 includes the positioning post 4312 protruding from an upper side of the connecting member body 431. The positioning post 4312 is used for prepositioning end portions of two adjacent horizontal support members 41. Further, referring to FIG. 3, a plurality of horizontal support members 41 are connected head to tail by a plurality of the first connecting members 43, forming a handrail edge of the above-ground pool 10. The horizontal support member 41 may have a width configured to support an object placed thereon. In an example aspect shown in FIG. 7*a* and FIG. 7*b*, four positioning posts 4312 are symmetrical two by two and are disposed at an angle with respect to each other, to thereby conform to an included angle between two adjacent horizontal support members 41. Correspondingly, an end portion of the horizontal support member 41 includes a through hole 411 configured to hold the positioning post 4312 therewithin. Each end portion of each horizontal support member 41 may include two through holes 411, and at least one of the two through holes 411 may be a slotted hole, to thereby enable adjustment of a joint position of the positioning post 4312 in the through hole 411, to eventually implement that the plurality of horizontal support members 41 are connected head to tail. According to another example embodiment, the shapes of the positioning post 4312 and the through hole 411 may adapt to each other, and for example, may each have a shape of a triangle, a square, or another polygon, to implement accurate prepositioning and stable connection. The quantities and positions of the positioning posts 4312 are not limited by the examples shown in the drawings.

Figure 7A:
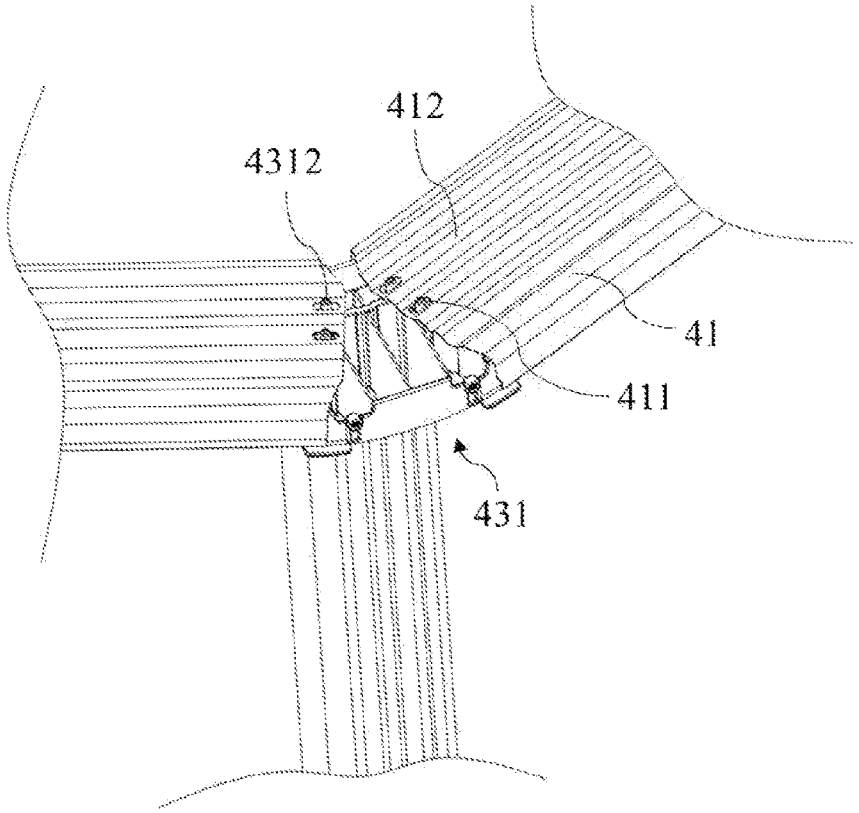
FIG. 7*a* is a three-dimensional schematic diagram of an installed state of a connecting member body of a first connecting member and a horizontal support member.
Figure 8A:
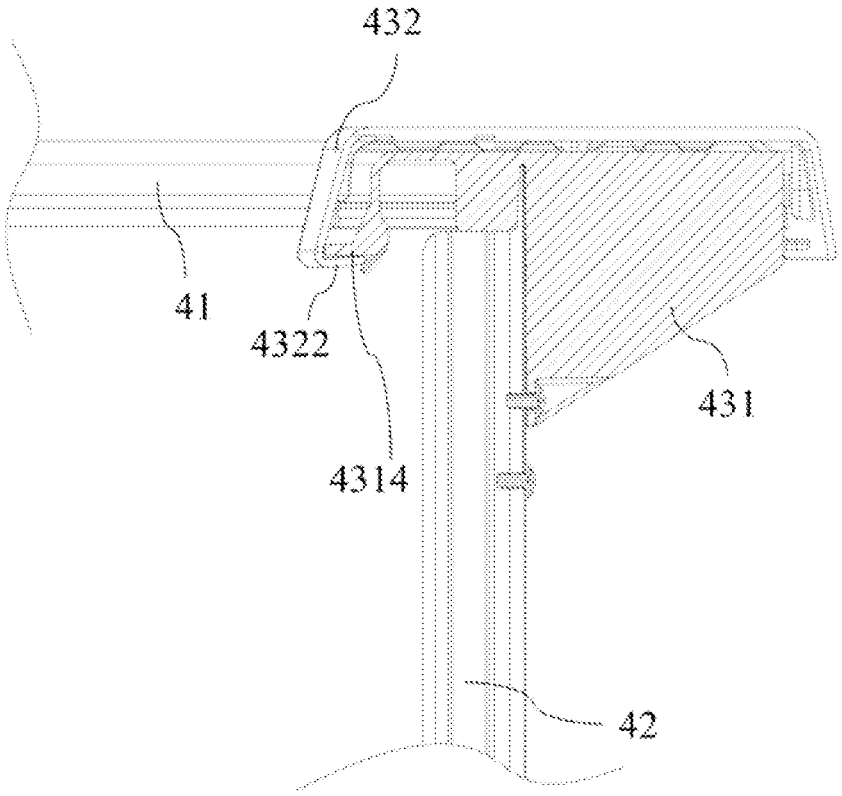
FIG. 8*a* is a schematic sectional view of an installed state of the first connecting member of FIG. 4.
Figure 8B:
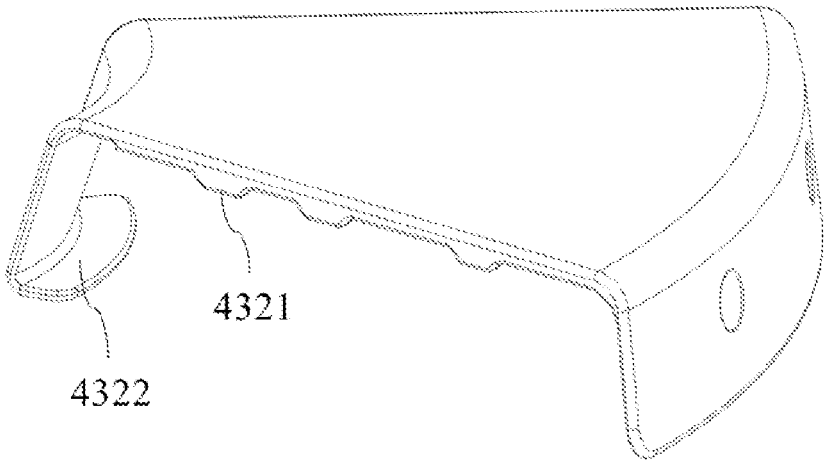
FIG. 8*b* is a three-dimensional schematic top view of a protective cover of the first connecting member, according to an example embodiment.

The horizontal support member 41 is sleeved over the positioning post 4312 through the through hole 411 of the horizontal support member to thereby implement prepositioning. Every two adjacent connecting member bodies 431 support one horizontal support member 41. In addition, as shown in FIG. 8*a* to FIG. 8*b*, the first connecting member 43 includes the protective cover 432 which may limit the separation between the horizontal support member 41 and the positioning post 4312. The protective cover 432 and the connecting member body 431 coordinate to clamp the horizontal support member 41 therebetween. Optionally, a convex tooth 4321 may be provided on an inner side (a side facing the connecting member body 431) of the protective cover 432, and the convex tooth 4321 may be adapted to some or all of grooves 412 (as shown in FIG. 7*a*, the surface of the horizontal support member 41 is provided with a plurality of grooves 412) in the surface of the horizontal support member 41, to thereby limit a displacement of the horizontal support member 41.

Figure 7B:
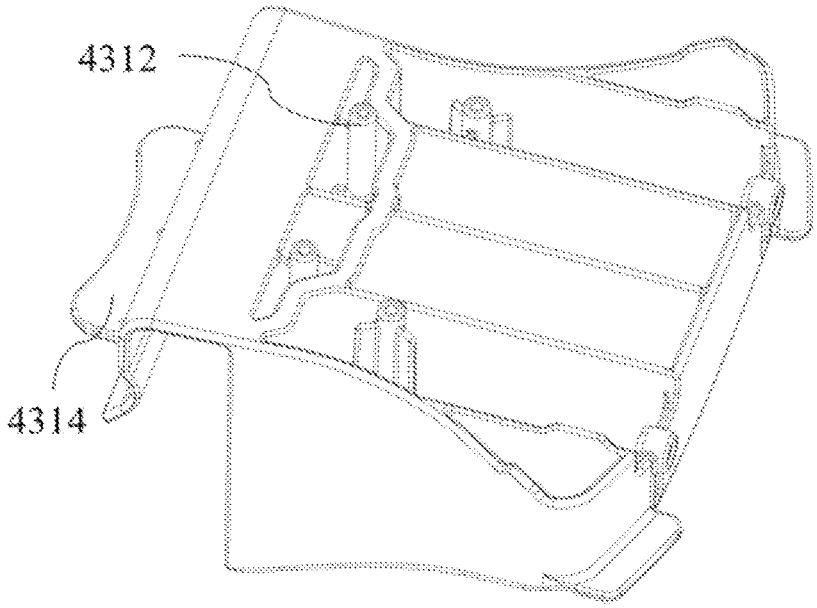
FIG. 7*b* is a three-dimensional schematic top view of the connecting member body of FIG. 7*a*.

According to an example embodiment, as shown in FIG. 7*b* and FIG. 8*b*, the connecting member body 431 may include a clamping tongue 4314. The protective cover 432 is provided with a clamping hook 4322. The clamping hook 4322 is joined to the clamping tongue 4314, such that, at one end the protective cover 432 is connected to the connecting member body 431, and at the other end, the protective cover 432 is connected to the connecting member body 431 by a threaded fastener, as shown in FIG. 5*a*. Alternatively, the protective cover 432 may be connected to the connecting member body 431 in a completely clamping manner.

According to an example embodiment, after the vertical support member 42 is inserted into the first connecting member 43 and the second connecting member 44, the vertical support member 42, and the first connecting member 43 and the second connecting member 44 can be further locked by threaded fasteners. Specifically, as shown in FIG. 5*a* and FIG. 8*a*, the connecting member body 431 may include a first connecting hole 4315. The top end of the vertical support member 42 may include a first mounting hole 421. When the vertical support member 42 is inserted into the bottom of the first insertion slot 4311, the first connecting hole 4315 and the first mounting hole 421 are aligned, and may then be connected by a threaded fastener. Similarly, as shown in FIG. 6, the second connecting member 44 may include a second connecting hole 443. The bottom end of the vertical support member 42 may include a second mounting hole 422. When the vertical support member 42 is inserted into the bottom of the second insertion slot 441, the second connecting hole 443 and the second mounting hole 422 are aligned, and may then be connected by a threaded fastener. However, when the first insertion slot 4311 and the second insertion slot 441 have sufficient depths, locking can be implemented without threaded fasteners.

Figure 2:
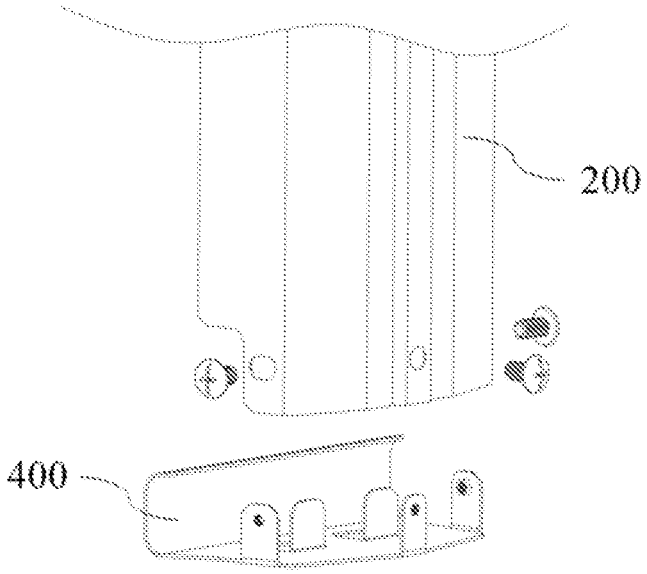
FIG. 2 is a schematic exploded view of a connection of vertical post and a lower fixing member, according to the related art.

The connecting member body 431 of the first connecting member 43 may be a single integral member which can enable prepositioning between the connecting member body 431 and the vertical support member 42 and the horizontal support member 41. Compared with the use of a plurality of bolt fasteners shown in FIG. 1 and FIG. 2, installation steps may be greatly simplified. Materials of the first connecting member 43 and/or the second connecting member 44 may be plastic. The connecting member body 431 and the protective cover 432 of the first connecting member 43 and/or the second connecting member 44 may be respectively formed in an injection molding manner, to achieve advantages of simple manufacturing and corrosion resistance.

Compared with an existing design, the first connecting member 43 and the second connecting member 44 according to one or more example embodiments may enable completion of the installation of the support assembly 4 in an efficient and economical manner.

It may be understood that the exemplary embodiments described herein may be considered in a descriptive sense only and not for purposes of limitation. Descriptions of features or aspects within each exemplary embodiment may be considered as available for other similar features or aspects in other exemplary embodiments.

While exemplary embodiments have been described with reference to the figures, it will be understood by those of ordinary skill in the art that various changes in form and details may be made therein without departing from the spirit and scope as defined by the following claims.

What is claimed is:

1. An above-ground pool, comprising:

a base;

a surrounding wall comprising: a lower edge joined to the base, and an upper edge;

a pool liner, detachably connected to an inner side of the surrounding wall, wherein the pool liner defines a water storage space therewithin; and a support assembly, comprising:

a plurality of horizontal support members, a plurality of vertical support members, each having a three dimensional outer contour, a plurality of first connecting members, each connecting an upper end of one of the plurality of vertical support members to two of the plurality of horizontal support members, and a plurality of second connecting members, each connecting a lower end of one of the plurality of vertical support members to the base, wherein each of the plurality of first connecting members comprises a first insertion slot having a shape corresponding in three dimensions to the outer contour of the one of the plurality of vertical support members; and wherein each of the plurality of second connecting members comprises a second insertion slot having a shape corresponding in three dimensions to the outer contour of the one of the plurality of vertical support members.

2. The above-ground pool according to claim 1, wherein each of the plurality of the first connecting members comprises:

a connecting member body comprising the first insertion slot and a positioning post disposed opposite the first insertion slot, the positioning post configured to connect to end portions of the two of the plurality of horizontal support members, and a protective cover.

3. The above-ground pool according to claim 2, wherein each of the plurality of horizontal support members comprises a through hole, formed through an end thereof and configured to hold the positioning post.

4. The above-ground pool according to claim 2, wherein the protective cover limits a separation of the two of the plurality of horizontal support members from the positioning post, and wherein the protective cover is configured to be fixed to the connecting member body by at least one of clamping and threaded fastening.

5. The above-ground pool according to claim 2, wherein the protective cover comprises a convex tooth disposed on an inner side of the protective cover, and wherein each of the plurality of horizontal support members comprises a groove, disposed in a surface thereof and having a shape corresponding to a shape of the convex tooth.

6. The above-ground pool according to claim 2, wherein the connecting member body further comprises a first receiving groove configured to accommodate therein the upper edge of the surrounding wall, and wherein each of the plurality of second connecting members comprises a second receiving groove configured to accommodate therein the lower edge of the surrounding wall.

7. The above-ground pool according to claim 2, wherein the connecting member body further comprises a first connecting hole, wherein each of the plurality of second connecting members further comprises a second connecting hole, and wherein each of the lower end and the upper end of each of the plurality of vertical support members comprises a mounting hole configured to be connected to one of the first connecting hole and the second connecting hole by a threaded fastener.

8. The above-ground pool according to claim 2, wherein the connecting member body consists of a single integral member.

9. The above-ground pool according to claim 8, wherein each of the plurality of first connecting members and the plurality of second connecting members is plastic.

10. The above-ground pool according to claim 1, wherein the surrounding wall is rigid in a first direction and is rollable in a second direction, perpendicular to the first direction.

11. A support assembly of an above-ground pool, the support assembly comprising:

a plurality of horizontal support members;

a plurality of vertical support members, each having a three-dimensional outer contour;

a plurality of first connecting members, each connecting an upper end of one of the plurality of vertical support members to two of the plurality of horizontal support members; and a plurality of second connecting members, each connecting a lower end of one of the plurality of vertical support members to a base of the above-ground pool;

wherein each of the plurality of first connection members comprises a first insertion slot having a shape corresponding in three dimensions to the outer contour of the one of the plurality of vertical support members; and wherein each of the plurality of second connecting members comprises a second insertion slot having a shape corresponding in three-dimensions to the outer contour of the one of the plurality of vertical support members.

12. The support assembly according to claim 11, wherein each of the plurality of first connecting members comprises:

a connecting member body comprising the first insertion slot and a positioning post disposed opposite the first insertion slot, the positioning post configured to connect to end portions of the two of the plurality of horizontal support members; and a protective cover.

13. The support assembly according to claim 12, wherein each of the plurality of horizontal support members comprises a through hole, formed through an end thereof and configured to hold the positioning post.

14. The support assembly according to claim 12, wherein the protective cover comprises a convex tooth disposed on an inner side of the protective cover, and wherein each of the plurality of horizontal support members comprises a groove, disposed in a surface thereof and having a shape corresponding to a shape of the convex tooth.

15. The support assembly according to claim 13, wherein the connecting member body further comprises a first connecting hole, wherein each of the plurality of second connecting members further comprises a second connecting hole, and wherein each of the lower end and the upper end of each of the plurality of vertical support members comprises a mounting hole configured to be connected to one of the first connecting hole and the second connecting hole by a threaded fastener.

16. The support assembly according to claim 13, wherein the connecting member body consists of a single integral member.

17. The support assembly according to claim 16, wherein each of the plurality of first connecting members and the plurality of second connecting members is plastic.

18. The above-ground pool according to claim 1, wherein:

a cross section of the three-dimensional outer contour of each of the plurality of vertical support members comprises a plurality of bends; and each of the first insertion slot and the second insertion slot is nonlinear and comprises a plurality of bends.

19. The support assembly according to claim 11, wherein:

a cross section of the three-dimensional outer contour of each of the plurality of vertical support members comprises a plurality of bends; and each of the first insertion slot and the second insertion slot is nonlinear and comprises a plurality of bends.

* * * * *